US005145762A

United States Patent [19]

Grushkin

[11] Patent Number: 5,145,762

[45] Date of Patent: Sep. 8, 1992

[54] PROCESSES FOR THE PREPARATION OF TONERS

[75] Inventor: Bernard Grushkin, Pittsford, N.Y.

[73] Assignee: Xerox Corporation, Stamford, Conn.

[21] Appl. No.: 677,076

[22] Filed: Mar. 29, 1991

[51] Int. Cl.[5] ..... G03G 13/20; G03G 9/14

[52] U.S. Cl. ..... 430/137; 430/106.6

[58] Field of Search ..... 430/137, 106.6

[56] References Cited

U.S. PATENT DOCUMENTS 4,298,672 11/1981 Lu ..... 430/108
4,338,390 7/1982 Lu ..... 430/106
4,450,221 5/1984 Terada et al. ..... 430/106.6
4,600,676 7/1986 Terada et al. ..... 430/106.6
4,937,157 6/1990 Haack et al. ..... 430/110
4,973,439 11/1990 Chang et al. ..... 264/101
4,990,424 2/1991 Van Dusen et al. ..... 430/109

*Primary Examiner*—Marion E. McCamish
*Assistant Examiner*—S. Rosasco
*Attorney, Agent, or Firm*—E. O. Palazzo

[57] ABSTRACT

A process for the preparation of toner compositions which comprises melt blending toner resin particles, magnetite particles, wax, and charge additives; adding to the aforementioned mixture a coupling component; injecting water therein; and cooling.

20 Claims, No Drawings

PROCESSES FOR THE PREPARATION OF TONERS

BACKGROUND OF THE INVENTION

This invention is generally directed to processes for the preparation of toner and developer compositions, and more specifically, the present invention is directed to processes for the preparation of magnetic toners containing coupling agents. In one embodiment, there are provided in accordance with the present invention processes for the preparation of toner compositions comprised of resin particles, pigment particles, charge enhancing additives, and a coupling agent, especially organotitanate coupling agents, which processes in an embodiment comprises extruding the toner components while injecting water therein. In one embodiment, the economical process of the present invention comprises introducing a coupling agent and water into a toner blend during the melt mixing step accomplished, for example, in a known toner extruder, such as the ZSK-53 manufactured by Werner-Fleiderer. Advantages associated with the process of the present invention in embodiments thereof include use of economical, readily available magnetites, and coupling agents, which components can, for example, be significantly lower in cost than that of pretreated magnetite; the process is readily adaptable to a variety of pigments including carbon black and color pigments; a reduction in the extruder torque; the injecting of water into the extruder causes a reduction in temperature, facilitates scavenging unreacted coupling agent and provides for the removal of volatile impurities.

In an embodiment, the process of the present invention comprises introducing a known coupling agent to a preblended mixture of toner constituents comprised, for example, of resin particles and pigment particles prior to extrusion. More specifically, the coupling agent can initially be adsorbed onto a substrate such as silica, and the resulting modified silica powder can then be added to the other toner components. This embodiment has the added advantage of improving the preblend powder flow which is to be fed to the extruder. Also, by adsorbing the coupling agent onto the substrate, its inclusion in the melt mix process can be facilitated.

The toners obtained with the process of the present invention can be selected for a number of imaging methods, including xerographic imaging and printing processes wherein latent images are developed and transferred to supporting substrates such as paper.

Processes for the preparation of toner compositions by melt blending and extrusion are well known. In these processes, polymer, pigment, additive, and the like can be added to a melt mixing apparatus, such as a Banbury Mill, followed by heating at a temperature, for example, of above 120° C., cooling, micronization of the resulting toner, followed by classification to provide toner particles with an average particle diameter of from about 10 to about 25 microns. In U.S. Pat. No. 4,600,676, the disclosure of which is totally incorporated herein by reference, there is illustrated the preparation of toners directly by polymerizing a monomer in the presence of a titanate coupling agent, see the Abstract for example. In column 10 of this patent, it is indicated that the titanate coupling agent is present in the polymerization reaction at the time of reaction, and in Example 1, column 16, an aqueous polyvinyl alcohol solution is selected as part of the reaction mixture. In U.S. Pat. No. 4,450,221, the disclosure of which is totally incorporated herein by reference, there is illustrated the preparation of single component toners wherein there is selected a magnetite rendered hydrophobic by surface treatment with a titanium, or silicone coupling agent. The '221 patent discloses magnetites which have been pretreated with coupling agent. One disadvantage of using a pretreated magnetite relates to its cost, about 1.5 to 3 times higher in cost, as compared to untreated magnetites. Furthermore, commercial sources for pretreated magnetites with magnetic and lyophilic properties that are suitable for a number of xerographic toner compositions is limited. By treating the magnetite with coupling agent during toner fabrication, therefore, greater flexibility in choice of magnetite and coupling agent can be achieved.

Also, developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function. According to this patent, a variety of conventional anionic moieties such as halides, phosphates, acetates, nitrates, benzoates, methylsulfates, perchloride, tetrafluoroborate, benzene sulfonate, and the like can be selected. U.S. Pat. No. 4,221,856 discloses electrophotographic toners containing resin compatible quaternary ammonium compounds in which at least two R radicals are hydrocarbons having from 8 to about 22 carbon atoms, each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. The aforementioned toners are usually prepared by melt blending processes as mentioned herein.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrate a toner with a distearyl dimethyl ammonium methyl sulfate charge additive. One disadvantage that may be associated with the charge additive of the '635 patent resides in its apparent inherent instability in some instances as the additive may thermally and chemically degrade, and react with other toner components.

The following prior art, all United States patents, is mentioned, and wherein the toners indicated can be prepared by known melt blending and extrusion methods: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethyl sulfonate; also note, for example, the information presented in columns 2 and 3 of this patent; a similar teaching is presented U.S. Pat. No. 4,834,921; U.S. Pat. No. 4,490,455 which discloses toners with, for example, amine salt charge enhancing additives, reference the Abstract of the Disclosure for example, and wherein A is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; Reissue 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3; U.S. Pat. No. 4,323,634 which discloses toners with charge additives of the formulas presented in column 3, wherein at least one of the R's is a long chain amido group, and X is a halide ion or an organosulfur containing group, U.S. Pat. No. 4,326,019 relating to toners with long chain hydrazinium compounds, wherein the anion A can be a sulfate, sulfonate, phosphate, halides, or nitrate, see the Abstract of the Disclosure for example; U.S. Pat. No. 4,752,550 which illustrates toners with inner salt charge additives or mixtures of charge additives, see for example column 8; U.S. Pat. No. 4,684,596 which discloses toners with charge additives of the formula provided in column 3, wherein X can be a variety of anions such as trifluoromethane sulfonate; and U.S. Pat. Nos. 4,604,338; 4,792,513; 3,893,935; 4,826,749 and 4,604,338, the disclosure of each of the aforementioned patents being totally incorporated herein by reference.

The following prior art, all U.S. patents, is mentioned: U.S. Pat. No. 4,812,381 relating to toners and developers with quaternary ammonium salts of the formula illustrated in column 3, the preparation thereof, see column 4, and also note the working Examples, columns 7 and 8, wherein specific charge additives, such as octadecyl ammonium trifluoromethane sulfonate, are reported; U.S. Pat. No. 4,675,118 which discloses certain quaternary salts as fabric softeners, see the Abstract of the Disclosure, and note column 1, for example, wherein X is as recited including $OSO_3CH_3$ and halide; U.S. Pat. No. 4,752,550, the disclosure of which is totally incorporated herein by reference, directed to toners and developers with inner salt charge additives and mixtures of such salts with other charge additives, see for example column 4; U.S. Pat. No. 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example; and U.S. Pat. No. 4,058,585 which discloses a process of extracting metals with organic solvent solutions of the salts of hydrogen ionic exchange agents, and quaternary ammonium compounds. Processes for preparing quaternary ammonium salts by an ion exchange or ion pair extraction method with soluble quaternary compounds is known, reference for example *Phase Transfer Catalysis, Principles and Techniques*, Academic Press, N.Y., 1978, especially page 76, C. M. Starks and C. Liotta, the disclosure of this textbook being totally incorporated herein by reference, and "Preparative Ion Pair Extraction", *Apotekarsocieteten/Hassle, Lakemidel*, pages 139 to 148, Sweden, 1974, the disclosure of which is totally incorporated herein by reference, which illustrates the preparation of certain bisulfates with water soluble ammonium salt reactants and a two-phase method wherein the product resides in the water phase.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Illustrated in U.S. Pat. No. 4,937,157, the disclosure of which is totally incorporated herein by reference, are toner compositions comprised of resin, pigment or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the toners of the aforementioned '157 patent, which toners can be prepared by melt blending. The tetrasubstituted ammonium salt selected can be heated in an appropriate solvent or solvents, such as water, in the presence of a stoichiometric amount of sulfuric acid. One typical process of preparation involves heating at an effective temperature of, for example, from about 40° to about 100° C. for an appropriate period of time, such as from about 5 to about 15 hours, the insoluble tetrasubstituted ammonium chloride or other halide, such as distearyl dimethyl ammonium chloride (DDACI), or the corresponding methyl sulfate salt, distearyl dimethyl ammonium methyl sulfate (DDAMS) in aqueous solution, about one molar equivalent in 85 molar equivalents of water and 10 molar equivalents of sulfuric acid in 56 molar equivalents of water. The crude product resulting after cooling to room temperature can be collected by filtration, and then purified by washing with various solvents such as acetone, followed by recrystallization from, for example, an appropriate solvent such as acetone or methanol, and the like. The resulting products, which can be identified by a number of techniques including melting point information, differential scanning calorimetry, infrared spectra, carbon, and proton nuclear magnetic resonance, ion chromotography, elemental analysis, and the like, can then be formulated into toners by melt blending.

SUMMARY OF THE INVENTION

It is a feature of the present invention to provide processes for the preparation of toner and developer compositions with charge enhancing additives with many of the advantages illustrated herein.

Another feature of the present invention resides in the provision of processes for the preparation of toners with excellent triboelectric characteristics, and acceptable development characteristics at humidities of from about 20 to about 80 percent; as well as excellent development at 80° F./80 percent RH (relative humidity), 72° F. and 50 percent RH, and 55° F. and 20 percent RH.

Further, another feature of the present invention resides in the economical preparation of toner compositions with hydrophobic magnetite.

In another feature of the present invention there are provided positively charged toner compositions useful for the development of electrostatic latent images including color images.

Also, in another feature of the present invention there are provided developer compositions with positively charged toner particles, carrier particles, and the enhancing additives illustrated herein, or mixtures of these additives with other known charge enhancing additives.

In yet a further feature of the present invention there are provided humidity insensitive, from about, for example, 20 to 80 percent relative humidity at temperatures of from 55° to 80° F. as determined in a relative humidity testing chamber, positively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Additionally, in a further feature of the present invention there are provided positively charged magnetic toner compositions, and positively charged colored toner compositions containing therein, or thereon charge additive.

In yet another feature of the present invention are provided negatively charged magnetic toner compositions, wherein coupling agent and hydrophilic magnetite are reacted during melt mixing of the toner components to generate a toner composition whose development characteristics are independent of RH, between 20 and 80 percent thereof.

These and other features of the present invention can be accomplished in embodiments thereof by providing toner compositions comprised of resin particles, pigment particles, and charge enhancing additives, and wherein the toner can be prepared by introducing a coupling agent and water to a toner blend during the melt mixing step. In one embodiment, the process of the present invention comprises the injection of water and coupling agent while extruding the toner resin, charge additive and untreated pigment, such as magnetite. In an embodiment of the present invention, toners are prepared by melt blending toner resin, including resins with a bimodal molecular weight distribution, magnetite, wax, and charge control additive in an extruder, such as the ZSK-53 extruder; adding during the extrusion and as the aforementioned mixture enters the extruder a coupling agent; and injecting water therein subsequently, which water can later be removed by a vacuum. Thereafter, the extrudate obtained can be crushed in a Fitzmill, micronized to toner size particles by, for example, air attrition in a Sturtevant mill, followed by classification thereby enabling toner particles with an average diameter of from about 10 to about 20 microns. There can then be added to the toner surface particle components, such as AEROSIL R972 TM, in effective amounts of from about 0.1 to about 1 percent.

A specific embodiment of the present invention relates to a process for the economical preparation of toners which comprises initially preparing a thoroughly mixed powder blend of toner constituents comprised, for example, of resin, pigment, and optional additives, such as charge additives. More specifically, in an embodiment of the present invention there is added to a known blender, such as a Lodige Blender, from about 30 to about 60 parts by weight of cubic magnetite, such as MAPICO BLACK TM obtained from Columbian Chemical Company, from about 40 to about 70 parts by weight of toner resin particles, like a styrene/n-butyl acrylate copolymer (58/42) with a monomer ratio of 86:14 and an average $M_w$ of 200,000 with a polydispersity of 40, from about 0.5 to about 2.0 weight percent of a charge enhancing agent, such as Bontron P-51 available from Orient Chemicals Company of Japan, and from about 2 to about 6 weight percent of a low molecular weight component, like polypropylene wax, such as 660P obtained from Sanyo Chemical Industries. The aforementioned constituents are intimately mixed by blending for about 10 minutes, after which the blend is added to an extruder, such as the extruder of U.S. Pat. No. 4,973,439, the disclosure of which is totally incorporated herein by reference, a Werner-Fleiderer ZSK-53 extruder, and the like, at from 150 to 200 pounds/hour, the temperature profile having been set in each of eight zones so that the extrudate temperature is between 340° F. and 400° F. Liquid trisostearoyl titanate coupling component can then be injected into the extruder at the third zone at such a rate to correspond to 0.1 to 1.5 weight percent of the total composition and from 0.5 to 2.0 percent by weight of the pigment composition. Water is added at a second injection port downstream at the fifth zone, corresponding to 2.5 weight percent of the total feed, and the water and other volatiles removed through a vacuum port prior to the extrudate moving through the die head. After rapid quenching by passing the extrudate strand through a water bath, that is at a temperature of about 21° C., the extrudate is crushed to from about 0.5 to about 2 millimeters particle size in a Hammermill and the powder reduced to toner size of from about 8 to about 20 microns in a known fluid energy mill. After suitable classification to reduce the number of fine particles of 4 microns or less to below 15 percent by number, and coarse particles of greater than 40 microns to about zero, the toner is surface treated with from about 0.1 to about 1.0 weight percent of a hydrophobic silica in a high speed blender. The resultant monocomponent toner was then tested in a xerographic imaging apparatus, such as the Xerox Corporation 1012 TM. The solid area optical density (SAD) of a series of toners with from 0.0 to 2.0 weight percent of titanium coupling agent incorporated in the toner increases with increasing amount of coupling agent, thus the SAD corresponds to that of toner with pretreated magnetite such as MB 22 obtained from Titan Kogyo of Japan, when 1.0 weight percent or more of coupling agent has been added to the toner formulation during extrusion. The developability of the toner, that is SAD vs. imaging potential, for those toners prepared by adding to the extruder the titanium coupling agent from 0.5 to 2.0 weight percent remains the same when xerographic development is accomplished at 75° F. and 50 percent RH or at 80° F. and 80 percent RH.

In another specific embodiment of the present invention, rather than inject liquid TTS into the extruder during the melt mix process, TTS adsorbed onto silica, such as the commercially available CAPOW KRTTS/H available from Kenrich Petrochemicals Inc., is added at from 0.5 to 2 weight percent to the components to be blended in a Lodige blender. The well dispersed powder blend is then introduced to the extruder for melt mixing as illustrated herein. Toner prepared by incorporating CAPOW KRTTS/H in the preblend, therefore, has after extrusion the following composition 0.3 to 1.3 weight percent of triisostearoyl titanate, 0.2 to 0.7 percent by weight of submicron silica, 30 to 60 parts by weight of cubic magnetite, 40 to 70 percent by weight of styrene/n-butyl acrylate copolymer, 0.5 to 2.0 percent by weight of charge enhancing agent and 2 to 6 percent by weight of polypropylene wax. This embodiment of the present invention has the added advantage that the powder blend thus prepared exhibits better flow properties, therefore, the powder mixture can be easily and uniformly fed to the extruder through an auger feeder. The remainder of the processing steps and evaluation are as illustrated herein for the liquid injection of TTS.

Embodiments of the present invention include a process for the preparation of toner compositions which comprises melt blending toner resin particles, magnetite particles, wax, and charge additives; adding to the aforementioned mixture a coupling component; injecting water therein; and cooling; and a process for the preparation of toner compositions which comprises melt blending toner resin particles, magnetite particles, wax, and charge additives in an extruder; adding to the aforementioned mixture as it enters the extruder a coupling component; subsequently injecting water therein; cooling; and micronizing.

Illustrative examples of suitable known toner resins selected for the processes, and the toner and developer compositions of the present invention include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, saturated mono-olefins such as ethylene, propylene, butylene, isobutylene and the like; unsaturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, 2-ethyl hexyl acrylate, dodecyl acrylate, n-octyl acrylate, phenyl acrylate, methyl methacrylate, ethyl methacrylate, and butyl methacrylate; acrylonitrile, methacrylonitrile, acrylamide, and mixtures thereof. Also, there can be selected styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; Pliotones; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 10,000, such as polyethylene and polypropylene; UNILIN TM hydroxy alcohols and paraffin waxes can be included in, or on the toner compositions as fuser roll release agents.

The resin particles are present in a sufficient, but effective amount, for example from about 40 to about 90 weight percent. Thus, when 1 percent by weight of the charge enhancing additive is present, and 10 percent by weight of pigment or colorant, such as carbon black, is contained therein, about 89 percent by weight of resin is selected.

Numerous well known suitable pigments can be selected as the colorant for the toner particles including, for example, carbon black, like REGAL 330® carbon black, BLACK PEARLS L®, nigrosine dye, aniline blue, and preferably magnetite, such as MAPICO BLACK® or mixtures thereof. Generally, the pigment particles are present in known effective amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of, for example, from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 60, and preferably from about 10 to about 50 weight percent can be selected.

A number of known charge enhancing additives can be selected such as those mentioned in the patents indicated herein, including distearyl dimethyl ammonium methyl sulfate, cetyl pyridinium chloride, tri n-butyl benzyl ammonium naphtholsulfonate, chromium azo complex such as Spilon TRH or a similar iron complex T-77, both available from Hodogaya Chemical, Inc., and the like. These additives are present in various effective amounts, such as for example from about 0.05 percent to about 10 percent and preferably from about 1 to about 5 weight percent.

As coupling agents, there can be selected those as illustrated in U.S. Pat. No. 4,600,676, the disclosure of which is totally incorporated herein by reference, and other known coupling components. Specific examples of coupling agents, either as a liquid or adsorbed onto a substrate such as silica, include isopropyl triisostearoyltitanate, isopropyl tri(dioctyl)phosphatotitanate, neopenty(diallyl)oxy trineodecanonyl titanate, which component is present in an effective amount of, for example, from about 0.1 to about 4.0 percent and preferably from 0.2 to 1.5 weight percent.

There can also be blended with the toner compositions external additive particles including flow aid additives, which additives are usually present on the surface thereof. Examples of these additives include colloidal silicas such as AEROSIL TM, metal salts and metal salts of fatty acids inclusive of zinc stearate, aluminum oxides, cerium oxides, titanium oxides and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, surface additives such as colloidal silicas such as AEROSIL TM can be surface treated with the charge additives of the present invention illustrated herein in an amount of from about 1 to about 30 weight percent and preferably 10 weight percent, followed by the addition thereof to the toner in an amount of from 0.1 to 10 and preferably 0.1 to 1 weight percent.

There can be included in the toner compositions of the present invention low molecular weight waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K. K., and similar materials. The commercially available polyethylenes selected have a molecular weight of from about 1,000 to about 4,500, it is believed, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the charge enhancing additives illustrated herein, coupling agents, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthracene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetocetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there can be mixed with the toner particles carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethyl methacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns thereby permitting them to possess sufficient density and inertia to avoid adherence to the electrostatic images during the development process. The carrier component can be mixed with the toner composition in various suitable combinations, however, in an embodiment about 1 to 5 parts per toner to about 100 parts to about 200 parts by weight of carrier are selected.

The toner and developer compositions of the present invention may be selected for use in electrostatographic imaging apparatuses containing therein conventional photoreceptors providing that they are capable of being charged negatively in embodiments thereof. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium, selenium alloys, such as selenium arsenic, selenium tellurium and the like; halogen doped selenium substances; and halogen doped selenium alloys. Other similar photoreceptors can be selected. Discharge area development may also be selected.

The single component (no carrier) magnetic toners of the present invention can be utilized by transferring the toner to a magnetic donor roll from a toner sump, the toner then passing between the donor roll and a charging-metering blade to provide a toner mass on the donor roll of from about 0.5 to about 1.5 milligrams/cm$^2$ with an average charge of 3 to 12 microcoulombs/gram as measured by collecting the toner from the magnetic roll in a known Faraday Cage apparatus. By applying suitable AC and DC bias between the magnetic roll and the photoreceptor which has a latent electrostatic image, toner will jump from the magnetic roll to the photoreceptor and develop the latent image thereon. The developed latent image on the photoreceptor can then be transferred to paper and fused.

The toner compositions can be jetted and classified subsequent to preparation to enable toner particles with a preferred average diameter of from about 5 to about 25 microns, and more preferably from about 8 to about 12 microns. Also, the toner compositions of the present invention may in embodiments it is believed possess a triboelectric charge of from about 0.1 to about 2 femtocoulombs per micron in embodiments thereof as determined by the known charge spectrograph; admix times of from about 5 seconds to about 1 minute, and more specifically from about 5 to about 45 seconds in embodiments thereof as determined by the known charge spectrograph. These toner compositions with rapid admix characteristics may enable, for example, the development of images in electrophotographic imaging apparatuses, which images have substantially no background deposits thereon, even at high toner dispensing rates in some instances, for example, exceeding 20 grams per minute; and further, such toner compositions may, it is believed, be selected for high speed electrophotographic apparatuses, that is those exceeding 70 copies per minute.

Also, the toner compositions of the present invention in embodiments thereof possess desirable narrow charge distributions, optimal charging triboelectric values, preferably of from 10 to about 40, and more preferably from about 10 to about 35 microcoulombs per gram with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The following examples are being supplied to further define various species of the present invention, it being noted that these examples are intended to illustrate and not limit the scope of the present invention. Parts and percentages are by weight unless otherwise indicated. Also, comparative data and Examples are presented.

EXAMPLE I

There was prepared in the extrusion device ZSK-53 obtained from Werner Pfleiderer a toner composition by adding thereto a powder blend comprised of 49.6 percent by weight of cubic magnetite MAPICO BLACK®, 46.9 percent by weight of styrene/n-butylacrylate copolymer (86:14) with a $M_w$ of 220,000 and an $M_D/M_D$ of 41, and a Tg of 65° C., 1.0 percent by weight of the charge enhancing agent BONTRON P-51 TM obtained from Orient Chemical Corporation, and 2.5 percent by weight of polypropylene wax 660P obtained from Sanyo Chemical Industries, Ltd. These components were then preblended in a Lodige Blender for thirty minutes after which the preblend was fed to the extruder at 175 pounds/hour and the extruder temperature was adjusted so that the extrudate leaving the die head had a temperature of 412° F. Triisostearoyl titanate (TTS), obtained from Kenrich Petrochemicals, Inc., was injected into the extruder at 13.2 grams/minute, corresponding to 1.0 weight percent, downstream in the third heating zone from the feed port while water was injected into the extruder barrel at the fifth heating zone at 33 grams/minute. Water and other volatiles were removed through a vacuum port located just prior to the die head. The extrudate was rapidly cooled by immersion in water followed by air drying after which it was rough crushed in a Hammer Mill and reduced to toner size by grinding in a Sturtevant Micronizer. The toner with volume median diameter of from 8 to 12 microns, as measured by a Coulter Counter, was then classified in a Donaldson Model B classifier for the purpose of removing fine particles with a volume median diameter below 4 microns and those particles with a volume median diameter above 20 microns. The classified toner surface was then modified by addition of a submicron hydrophobic silica such as Degussa R972 TM by blending for five minutes the aforementioned toner with 0.2 percent by weight of AEROSIL R972 TM in a Lodige Blender wherein the plows are rotated at 300 rpm and the chopper blades are rotating at 3,000 rpm. The resulting toner was then tested in the Xerox Corporation 1012 TM imaging apparatus. There resulted copies with images of high quality, solid area density of 1.3 to 1.4 as measured by a Macbeth Densitometer, and substantially no background deposits at a relative humidity of from about 20 to about 80 percent for temperatures of from about 50° F. to about 80° F. Also, the toner did not block or evidence agglomeration as determined by visual observation when stored at 125° F. for 48 hours.

EXAMPLES II and III

The process of Example I was repeated with the exceptions that 0.5 weight percent of TTS and (Example III) 2.0 weight percent of TTS were selected, and wherein 6.6 grams/minute and 26.4 grams/minute, respectively, were injected into the extruder. Substantially similar imaging results were obtained with the toner produced.

EXAMPLE IV

The process of Example I was repeated with the exception that no TTS was utilized. The resulting toner, when tested in the Xerox Corporation 1012 TM at 75° F. and 50 percent relative humidity, provided prints of poor image quality with low solid area densities. After setting the Xerox Corporation 1012 TM imaging apparatus darkness control to its highest setting for highest development potential, an SAD (solid area density) of 1.0 was obtained, and the background in nonimaged areas was high and unacceptable. When this toner was tested in an environmental chamber at a high RH of 80 percent and at 80° F., solid area image densities, as measured by a Macbeth Densitometer, of only 0.8 were obtained at the highest achievable darkness control level for the Xerox Corporation 1012 TM.

EXAMPLE V

The process of Example I was repeated with the exception that there was prepared a toner comprised of 50 percent by weight of MB22 magnetite treated with 1 percent by weight of TTS obtained from Titan Kogyo, 46.5 percent by weight of the styrene n-butylacrylate copolymer, 1.0 percent of P-51 and 2.5 percent of polypropylene 660P. Copier development characteristics of this toner were as follows, solid area density of 1.3 to 1.4, no background throughout machine development, excellent high quality images with substantially no background deposits when tested in an environmental chamber set at 75° F. and 50 percent RH or at 80° F. and 80 percent RH.

EXAMPLE VI

A toner composition was prepared from a preblend of 50 percent of MAPICO BLACK TM, 45.6 percent of styrene/n-butyl acrylate copolymer, 2.5 percent of polypropylene wax 660P, 1.0 percent of charge enhancing additive P-51, and 0.9 percent of CAPOW KRTTS/H, a mixture of fumed silica and TTS in a ratio of 35:65 obtained from Kenrich Petrochemicals, Inc., by repeating the process of Example I, except that no TTS or water was injected into the extruder during the melt mix step. This toner showed satisfactory copy quality and development characteristics that were comparable to those obtained with the toners of Example I. In machine tests accomplished in an environmental chamber set at from 50° to 80° F. and from 20 to 80 percent RH, copies with high solid area densities of 1.3 to 1.4 were produced with no background developed in nonimaged areas.

Other modifications of the present invention may occur to those skilled in the art subsequent to a review of the present application and these modifications, including equivalents thereof, are intended to be included within the scope of the present invention.

What is claimed is:

1. A process for the preparation of toner compositions consisting essentially of melt blending toner resin particles, magnetite particles, wax, and charge additives; subsequently adding the prepared said toner to an extruder; adding to the aforementioned toner as it enters the extruder a coupling component; subsequently injecting water therein; cooling; and micronizing.

2. A process in accordance with claim 1 wherein the melt blending is accomplished at a temperature of from about 275° F. to about 435° F. as measured by the temperature of the extrudate.

3. A process in accordance with claim 1 wherein the melt blending is accomplished for a period of from about 30 seconds to about 3 minutes.

4. A process in accordance with claim 1 wherein the extruder selected is a three lobe twin screw extruder with injecting and exit ports thereon.

5. A process in accordance with claim 1 wherein the water is injected from about 20 seconds to about 2.5 minutes after the coupling component is added.

6. A process in accordance with claim 1 wherein the coupling component is added at the extruder feed port about 20 seconds after the toner mixture enters the extrusion device.

7. A process in accordance with claim 1 wherein from about 30 to about 60 percent by weight of magnetite, about 40 to about 60 percent by weight of toner resin, about 0.5 to about 2.0 percent of charge enhancing additive, about 2.0 to 6.0 percent by weight of wax comprised of an aliphatic or oxidized polyethylene or polypropylene wax, and from about 0.1 to about 1.5 percent by weight of a titanium coupling component are selected.

8. A process in accordance with claim 1 wherein the resin particles are comprised of styrene acrylates, styrene methacrylates, a polyester, or styrene butadienes.

9. A process in accordance with claim 1 wherein a cubic magnetite is selected.

10. A process in accordance with claim 1 wherein the wax is comprised of a polypropylene, or polyethylene of a molecular weight average of from about 1,000 to about 20,000 with a density of from about 0.85 to about 0.95.

11. A process in accordance with claim 1 wherein the charge additive is distearyl dimethyl ammonium methyl sulfate, cetyl pyridinium chloride, tri n-butylbenzyl ammonium naphtholsulfonate, or Spilon Black.

12. A process in accordance with claim 1 wherein the coupling component is isopropyl triisostearoyltitanate, isopropyltri(dioctyl)phosphatotitanate, or neopentyl(diallyl)oxy trineodecanonyl titanate.

13. A process in accordance with claim 1 wherein the coupling component is adsorbed onto a substrate.

14. A process in accordance with claim 13 wherein the substrate is fumed silica, aluminum oxide, or titanium oxide.

15. A process in accordance with claim 1 wherein there is added to the toner obtained external additives.

16. A process in accordance with claim 1 wherein there is added to the toner obtained external additives comprised of metal salts of a fatty acid, colloidal silicas, aluminas, titanium oxides, inorganic titanates, zirconate salts, or mixtures thereof.

17. A process in accordance with claim 1 wherein the pigment particles are carbon black, magnetites, or mixtures thereof, cyan, magenta, yellow, red, blue, green, brown, and mixtures thereof.

18. A process in accordance with claim 1 wherein the injected water subsequent to cooling is removed from the toner.

19. A process in accordance with claim 18 wherein removal is accomplished by a vacuum.

20. A process for the preparation of a toner composition consisting essentially of initially melt blending toner resin particles, magnetite particles, wax, and a charge additive to enable the formation of a toner composition; adding said toner composition to a toner extrusion device; thereafter adding to the extrusion device a coupling component, subsequently injecting water into the extruder device; cooling the toner composition exiting from the extruder; and crushing and micronizing the toner obtained followed by classification thereof to enable toner particles with an average particle diameter of from about 10 to about 20 microns.

* * * * *